US006651978B2

(12) United States Patent
Lembrez

(10) Patent No.: US 6,651,978 B2
(45) Date of Patent: Nov. 25, 2003

(54) FRONTALLY AND LATERALLY LOADED FEED BIN

(75) Inventor: Franck Lembrez, Meudon (FR)

(73) Assignee: Neopost Industrie, Bagneux (FR)

( * ) Notice: Subject to any disclaimer, the term of this patent is extended or adjusted under 35 U.S.C. 154(b) by 35 days.

(21) Appl. No.: 10/043,181

(22) Filed: Jan. 14, 2002

(65) Prior Publication Data

US 2002/0100258 A1 Aug. 1, 2002

(30) Foreign Application Priority Data

Jan. 30, 2001 (FR) ..... 01 01201

(51) Int. Cl.[7] ..... B65H 1/10; B65H 1/12

(52) U.S. Cl. ..... 271/160

(58) Field of Search ..... 271/145, 147, 271/160, 37, 126, 142, 30.1, 128; B65H 1/00, 1/08, 1/10, 1/12, 3/30, 2/18, 1/22, 3/24

(56) References Cited

U.S. PATENT DOCUMENTS 4,007,925 A * 2/1977 DeRyke et al. ..... 271/160
4,265,442 A 5/1981 Cormier et al.
4,307,878 A * 12/1981 Kono ..... 271/22
5,005,820 A * 4/1991 Leemhuis ..... 271/127

FOREIGN PATENT DOCUMENTS

DE 29 39 342 A1 3/1980
FR 2782673 A 3/2000

* cited by examiner

*Primary Examiner*—Donald P. Walsh
*Assistant Examiner*—Kenneth W Bower
(74) *Attorney, Agent, or Firm*—Sughrue Mion, PLLC

(57) ABSTRACT

This invention relates to a laterally and frontally loaded document feed bin, comprising mobile means for pushing these documents against a supporting wall and a lever for selecting a mode of operation in order to select a first and a second position, these mobile pushing means comprising first thrust adjustment means in order, in a first selected position, to exert a first thrust pressure on said documents, and second thrust adjustment means in order, in a second selected position, to exert an additional trust pressure on said documents.

6 Claims, 2 Drawing Sheets

FRONTALLY AND LATERALLY LOADED FEED BIN

FIELD OF THE INVENTION

The present invention relates to the domain of handling flat articles and more particularly to a bin for feeding flat articles integrated in a document folding/insertion machine.

BACKGROUND OF THE INVENTION

An example of architecture of document folding/insertion machine is illustrated in Applicants' French Patent Application FR 2 782 673. FIG. 1 of this Application illustrates a second magazine 500 of advertizing inserts or reply-envelopes located below a first magazine 400 of empty envelopes or reply-envelopes.

In the first feed magazine, as the documents tend to escape by gravity, they are easily ejected and selected via take-up rollers 405, 406 and the guiding element 404, respectively, the mobile rear presser 403 merely compressing the stack of documents resting on a supporting plate 401 between two self-centred lateral guides 402, without supporting the weight thereof.

On the contrary, it is quite a different matter concerning the second feed magazine of which the rear presser 503 must withstand all the weight of the stack of documents. This results in frequent defects in entrainment, jammings, deformations and undesired multiple selections. In addition, the particular positioning of this magazine at the bottom and to the rear of the machine necessarily imposes thereon a lateral and frontal loading of the documents.

It is an object of the present invention to overcome the afore-mentioned drawbacks by providing a laterally and frontally loaded document feed bin. Another object of the invention is to propose a bin which has a sufficient loading capacity while being compact. It is a further object of the invention to produce a bin of which the pressure exerted on the stack of documents is adjustable depending on the type of documents loaded.

SUMMARY OF THE INVENTION

These objects are attained by a laterally and frontally loaded document feed bin, comprising mobile means for pushing these documents against a supporting wall, wherein it comprises a lever for selecting a mode of operation in order to select a first and a second position, and said mobile pushing means comprise first thrust adjustment means in order, in said first selected position, to exert a first thrust pressure on said documents, and second thrust adjustment means in order, in said second selected position, to exert an additional thrust pressure on said documents.

With this particular configuration, jammings and multiple entrainments are thus avoided due to a more or less great compression of the stack of documents depending on the type of documents processed.

According to a preferred embodiment, the mobile pushing means comprise a thrust plate supported by an articulated parallelogram mechanism on a chassis and moving against said first and second thrust adjustment means. These first and second thrust adjustment means preferably comprise elastic elements acting in traction.

The bin according to the invention advantageously further comprises a disengaging lever fast with said parallelogram mechanism and extending laterally towards the outside of this bin in order to lower said thrust plate and allow a user to effect a lateral and frontal loading of the documents by hand.

According to an advantageous characteristic, the first thrust adjustment means comprise a primary traction spring fixed by a first end to a first arm of said parallelogram mechanism and by a second end to said chassis, and the second thrust adjustment means comprise a secondary spring fixed by a first end to a second arm of said parallelogram mechanism and by a second end to the operation selection lever pivoting about a lug fixed on said chassis so as selectively to exert a determined force of traction on this second end.

The secondary spring preferably comprises a small traction spring, with contiguous or non-contiguous turns, of which one end forms said first end of said secondary spring and of which another end is extended by an axial rod terminating at the level of said second end of said secondary spring by a spirally wound open loop.

The present invention also relates to a folding/insertion machine integrating the afore-mentioned integrated document feed bin.

BRIEF DESCRIPTION OF THE DRAWINGS

The invention will be more readily understood on reading the following description given by way of non-limiting and indicative example, with reference to the accompanying drawings, in which.

DESCRIPTION OF PREFERRED EMBODIMENT

Figure 1:
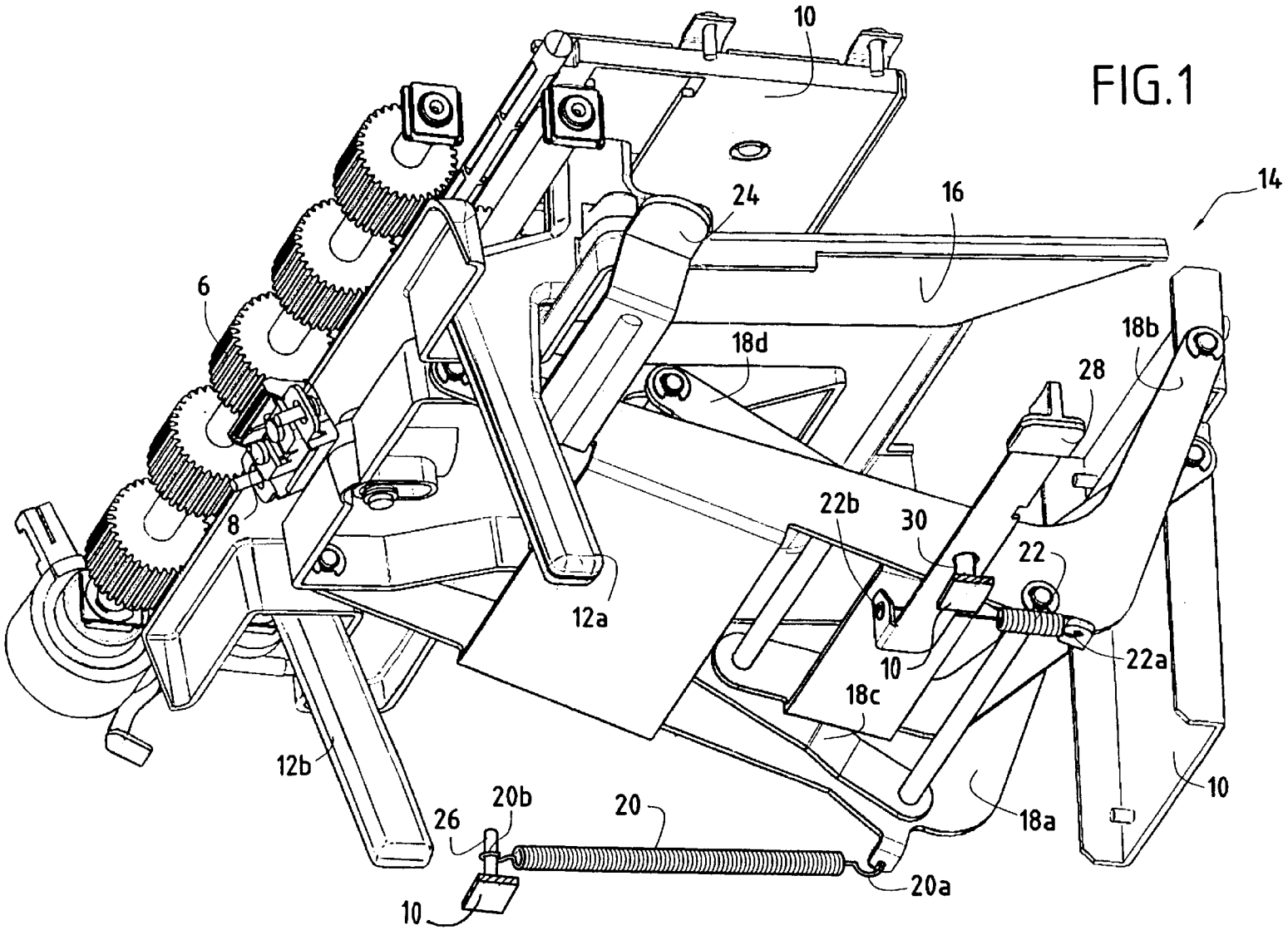
FIG. 1 is a view from underneath and in partial perspective of a feed bin according to the invention.

Referring now to the drawings, a bin for feeding documents of the envelope, reply envelope or advertizing insert type is illustrated in FIG. 1 in a view from underneath and in partial perspective.

Figure 2:
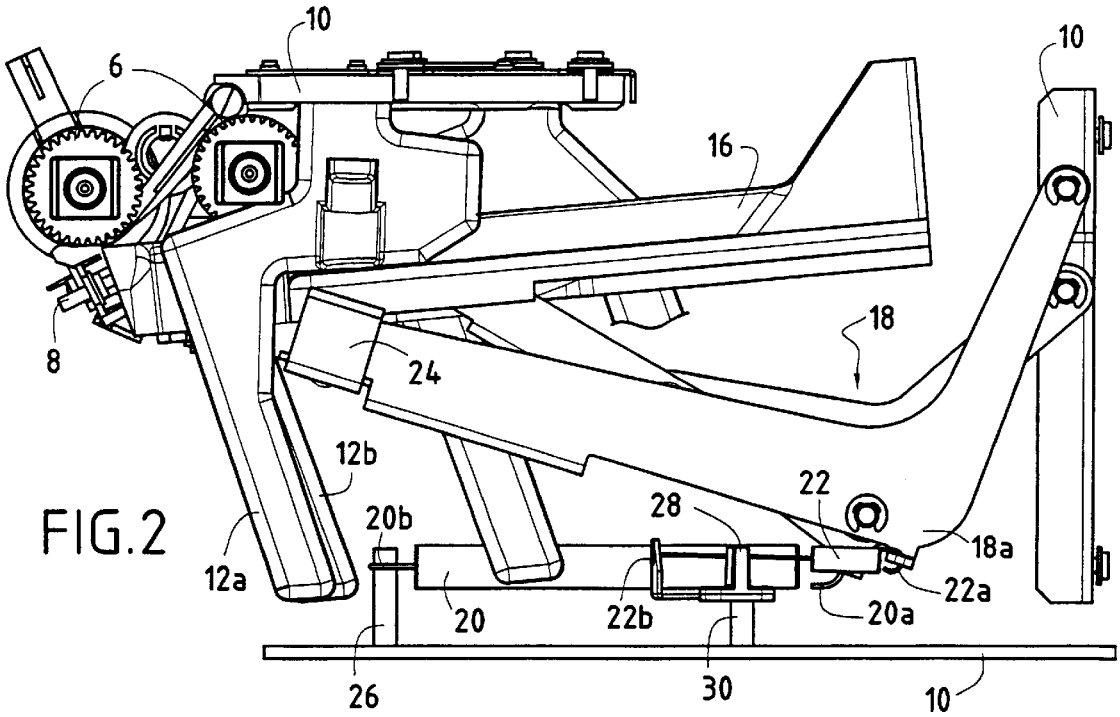
FIG. 2 is a side view of the feed bin of FIG. 1 in a position corresponding to a bin empty of documents.
Figure 3:
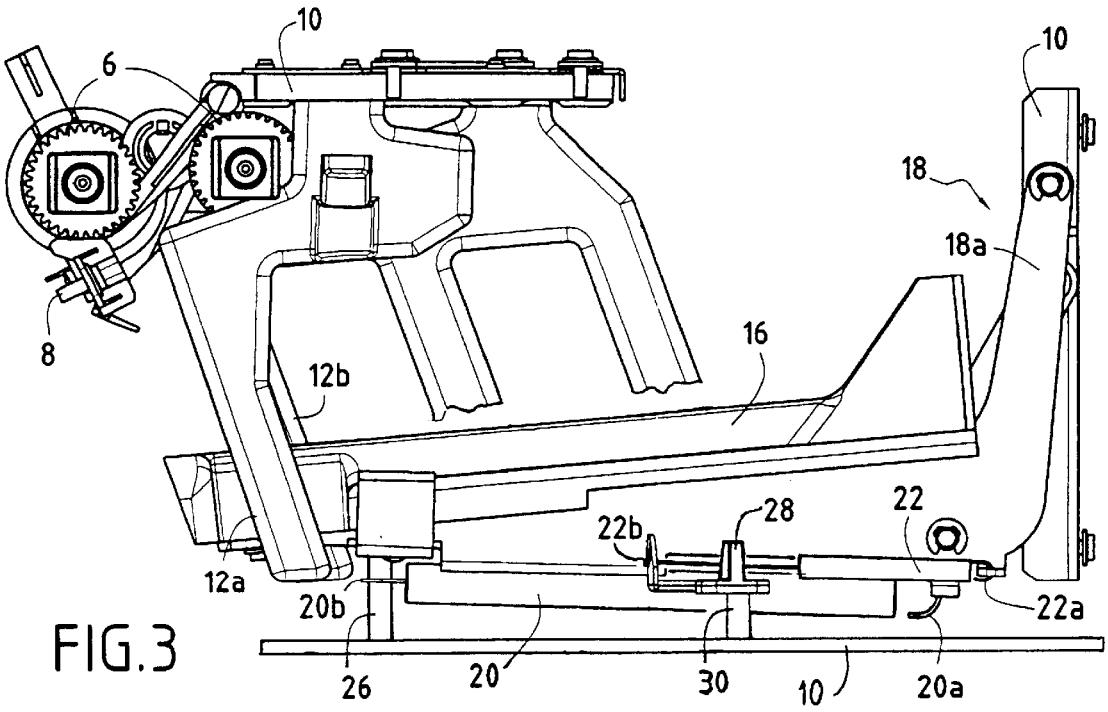
FIG. 3 is a side view of the feed bin of FIG. 1 in a position corresponding to a bin full of documents.

This laterally and frontally loaded bin (or magazine) is intended to be integrated in a docoument folding/insertion machine, at the rear of this machine, below an auxiliary feed bin of this machine. It comprises, mounted on a chassis 10 which, in the example illustrated, forms with the take-up rollers 6 and the guiding element 8 an integral part of the machine, two self-centering lateral guides 12*a*, 12*b* and mobile means (mobile presser 14) for pushing the stack of documents against a supporting wall of this chassis. These mobile pushing means comprise a thrust plate 16 articulated on the chassis 10 via a parallelogram mechanism 18 which moves against two separate means 20, 22 for adjusting the thrust exerted on the plate 16. This parallelogram mechanism, while conserving an inclination of the thrust plate slightly descending towards the take-up rollers and the guiding means, ensures an upward and downward movement of this plate between a first position corresponding to a bin empty of documents (cf. FIG. 2) and a second position corresponding to a bin full of documents (cf FIG. 3). Optimal stress on the stack of documents of the feed bin is maintained at any instant by the thrust adjustment means constituted by elastic elements acting in traction.

Housed under the thrust plate, this mechanism makes it possible to clear the space above the plate so as to procure a sufficiently high document loading capacity. The plate is lowered by hand by acting on a disengaging lever 24 fast with the parallelogram mechanism and extending laterally towards the outside of the bin in order to render it easier for a user of the machine to grasp.

The articulated parallelogram mechanism 18 essentially comprises two outer arms 18*a*, 18*b* and two pairs of inner arms (for example 18*c*, 18*d*), the thrust plate 16 being fixed to a first end of the two outer arms and of one of the two pairs of inner arms, their second end being fixed to the chassis 10. This mechanism may move against the two elastic elements 20, 22, acting in traction, one (a primary spring 20) being fixed by a first end 20*a* to one, 18*a*, of the two outer arms and by a second end 20*b* to the chassis 10 via a stud 26, and the other (a secondary spring 22) being fixed by a first end 22*a* to the other 18*b* of the two outer arms of the parallelogram mechanism and by a second end 22*b* to an operation selection lever 28 pivoting about a stud 30 fixed on the chassis 10 and which, depending on its position, will exert, nor not, a traction on this end and therefore activate, or not, this secondary spring.

To take into account the different physical characteristics of the loaded documents, particularly due to the fact that the advertizing inserts are more rigid than the envelopes or the reply envelopes and capable of presenting a rough surface, the mobile presser 14 is designed so as to exert two different stresses on the stack of documents depending on the nature of these documents. In effect, the envelopes or reply envelopes require a sufficient but non-excessive stress in order to avoid any difficulty of grip, any deformation or any multiple entrainments. On the contrary, the advertizing inserts require a greater stress but without being too excessive in order to avoid any braking of these inserts by friction.

These two stresses are obtained from two distinct positions of the selection lever 28, a rest position in which the secondary spring 22 is inactive (the lever not exerting any traction on its second end 22*b*), the thrust plate 16 in that case undergoing a first thrust pressure resulting from the sole traction of the primary spring 20, and a working position in which the action of this secondary spring is in that case added to that of the primary spring in order to increase the resistance to the weight of the stack of documents and to add an additional thrust pressure to the initial thrust pressure.

In effect, this secondary spring comprises a small traction spring, with contiguous or non-contiguous turns, of which one end constitutes the first end 22*a* of this secondary spring and of which the other end extends by an axial rod terminating at the level of the second end 22*b* of the secondary spring by a spirally wound open loop. This open loop allows easy assembly in a bore of small diameter in the selection lever 28 while ensuring an efficient support for this lever in its working position.

The feed bin according to the invention operates as follows: Firstly, the user actuates the disengaging lever 24 in order to lower the mobile presser 14 (provoking a traction of the primary spring 20) and to allow a lateral loading of a stack of documents on the thrust plate 16. Previously, he/she will have chosen a position for the selection lever 28 as a function of the documents of this stack, either the first rest position of this lever if he is loading reply envelopes not requiring too great a stress, or the second work position if he proceeds with the loading of inserts of greater thickness. Once the documents are in place, the spring or springs, by the return action that they exert on the thrust plate via the parallelogram mechanism 18, will cause this plate to rise until the first document (the one on the top of the stack) comes into contact with the take-up rollers 6 so as thereafter to be selected by the guiding element 8 and introduced in the machine. Under the action of the springs, the plate will, of course, then continue to rise, as the stack gets thinner, resulting from the introduction of the documents in the machine and until it comes into the terminal position of FIG. 2 corresponding to an empty feed bin.

What is claimed is:

1. A laterally and frontally loaded bin for pressing documents against take up rollers comprising:

a mobile pushing means that supports the documents;

a plurality of elastic elements that act in traction;

wherein the plurality of elastic elements apply thrust to the mobile pushing means which in turn applies pressure to the documents;

a lever having two positions;

wherein the plurality of elastic members exert a first thrust against the mobile pushing means when the lever is in the first position and an additional thrust when the lever is in the second position.

2. The feed bin of claim 1, wherein said mobile pushing means comprise a thrust plate supported by a parallelogram mechanism articulated on a chassis and moving against said first and second thrust adjustment means.

3. The feed bin of claim 2, wherein it further comprises a disengaging lever fast with said parallelogram mechanism and extending laterally towards the outside of this bin in order to lower said thrust plate and allow a user to effect a lateral and frontal loading of the documents by hand.

4. The feed bin of claim 2, wherein said first thrust adjustment means comprise a primary traction spring fixed by a first end to a first arm of said parallelogram mechanism and by a second end to said chassis, and said second thrust adjustment means comprise a secondary spring fixed by a first end to a second arm of said parallelogram mechanism and by a second end to the operation selection lever pivoting about a lug fixed on said chassis so as selectively to exert a determined force of traction on this second end.

5. The feed bin of claim 4, wherein said secondary spring comprises a small traction spring, with contiguous or non-contiguous turns, of which one end forms said first end of said secondary spring and of which another end is extended by an axial rod terminated at the level of said second end of said secondary spring by a spirally wound open loop.

6. A folding/insertion machine comprising the integrated document feed bin of claim 1.

* * * * *